US007282707B1

(12) United States Patent
Zanon

(10) Patent No.: US 7,282,707 B1
(45) Date of Patent: Oct. 16, 2007

(54) METHOD AND APPARATUS FOR HANDLING A SAMPLE PLATE FOR USE IN MASS ANALYSIS

(75) Inventor: Stephen Zanon, Campbell, CA (US)

(73) Assignee: Thermo Finnigan LLC, San Jose, CA (US)

( * ) Notice: Subject to any disclaimer, the term of this patent is extended or adjusted under 35 U.S.C. 154(b) by 204 days.

(21) Appl. No.: 11/171,907

(22) Filed: Jun. 30, 2005

(51) Int. Cl.
*H01J 49/04* (2006.01)

(52) U.S. Cl. ..... 250/288; 250/400; 250/281; 250/282; 250/440.11; 250/442.11

(58) Field of Classification Search ..... 250/288, 250/400, 424, 281, 282, 396 R, 423 R, 441.11, 250/442.11, 440.11, 492.1, 398, 491.1, 492.3
See application file for complete search history.

(56) References Cited

U.S. PATENT DOCUMENTS

RE37,485 E 12/2001 Vestal
6,825,466 B2 11/2004 Mordekhay
2002/0197722 A1 12/2002 Fichera et al.

*Primary Examiner*—Jack I. Berman
*Assistant Examiner*—Michael J Logie
(74) *Attorney, Agent, or Firm*—Sharon Upham

(57) ABSTRACT

A new sample plate handling apparatus for use with mass analysis, and methods for use the same have been developed. The sampling plate handling apparatus comprises a sample plate receiver which receives the sample plate in a first plane, a rotating device for rotating the sample plate from the first plane to a second plane, and a relocation device that relocates the sample plate in the second plane such that one of the samples on the sample plate is in the position desired for analysis by the mass analyzer. In one implementation, the relocation device can relocate the sample plate such that a beam of radiation that irradiates a sample on the sample plate emanates ionized particles that are substantially aligned with ion transfer optics of the mass analyzer.

18 Claims, 8 Drawing Sheets

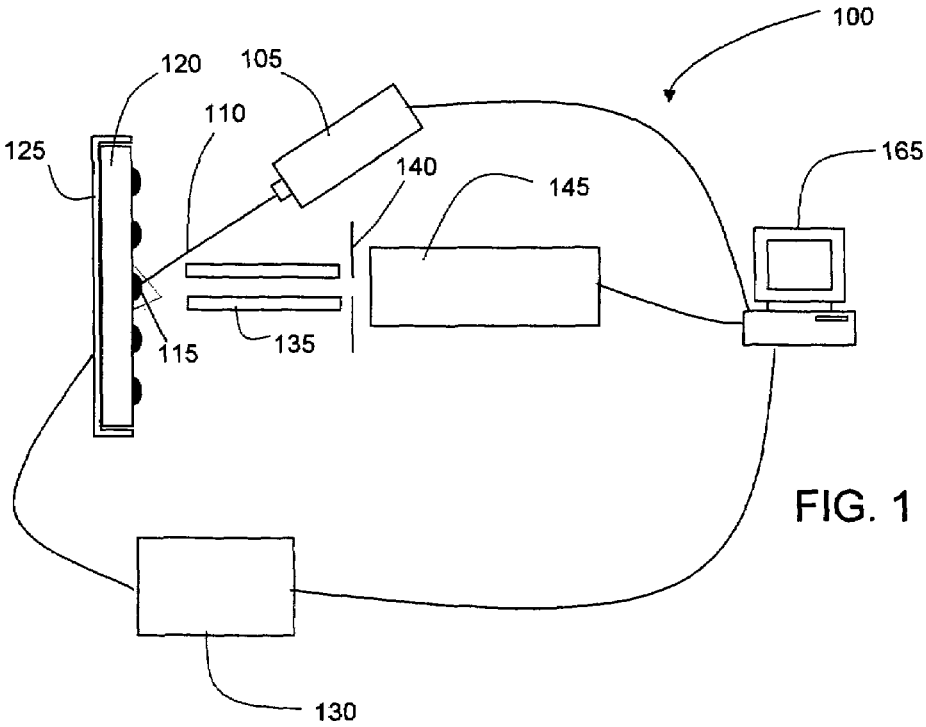
FIG. 1
FIG. 2
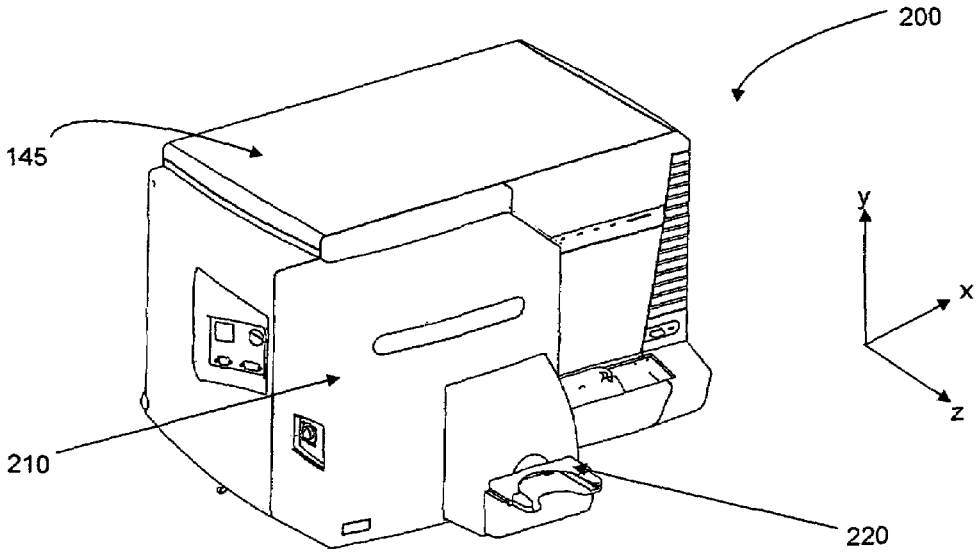

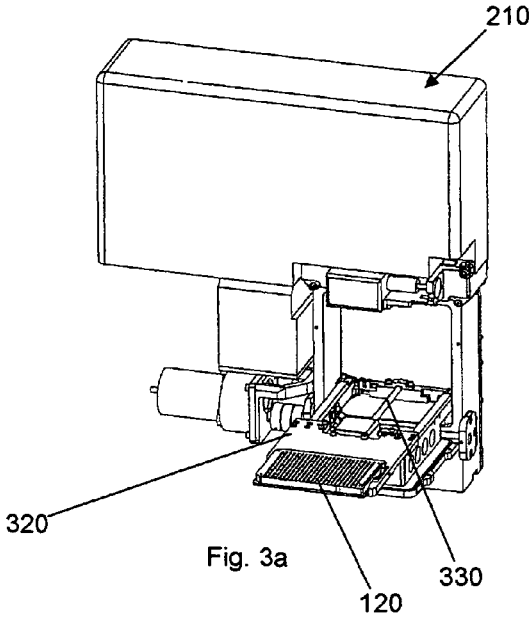
Fig. 3a
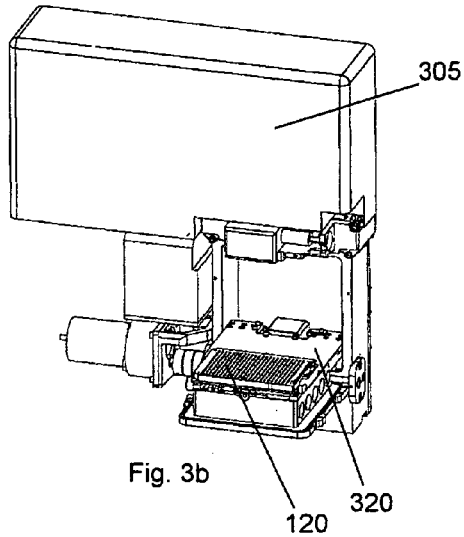
Fig. 3b
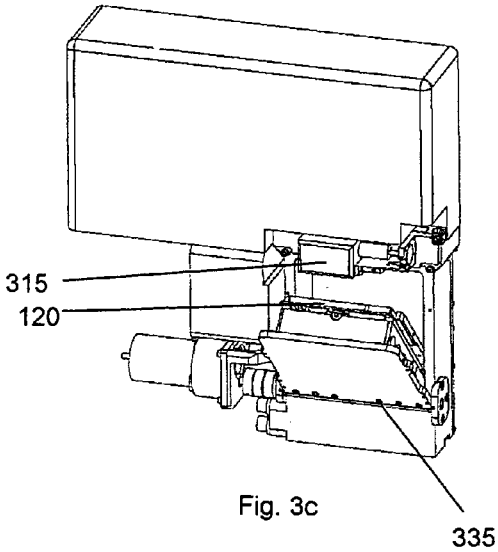
Fig. 3c
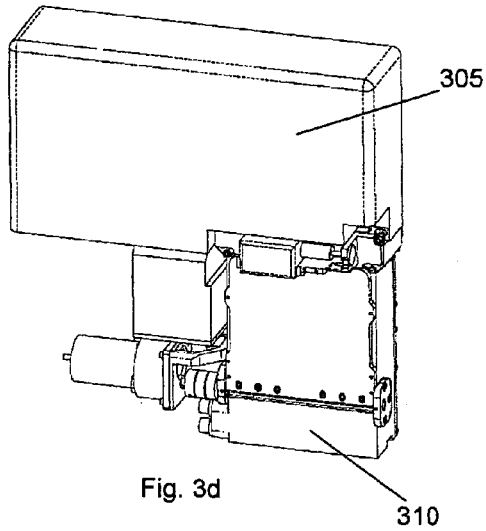
Fig. 3d
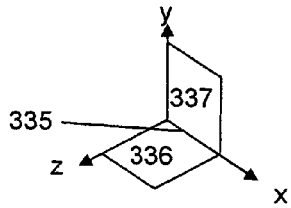

METHOD AND APPARATUS FOR HANDLING A SAMPLE PLATE FOR USE IN MASS ANALYSIS

FIELD OF THE INVENTION

The disclosed embodiments of the present invention relates generally to the field of transferring a sample plate from one place to another, or one environment to another, for eventual analysis by a mass analyzer.

BACKGROUND OF THE INVENTION

Matrix assisted laser desorption ionization (MALDI) mass spectrometry is a technique that provides minimal fragmentation and high sensitivity for the analysis of a wide variety of fragile and non-volatile compounds. MALDI is often combined with time-of-flight (TOF) mass spectrometry, FTICR, quadrupole ion trap, and triple quadrupole mass spectrometers, providing for detection of large molecular masses. These systems may be used to determine molecular weights of biomolecules and their fragment ions, monitor bioreactions, detect post-translational modifications, and perform protein and oligonucleotide sequencing, for tissue imaging, and many more applications.

The MALDI technique involves depositing the sample (analyte) and a matrix dissolved in a solvent as a spot on a sample plate. After the solvent has evaporated, the mixture of sample and matrix is left on the sample plate. The sample plate bearing the sample spots is inserted into the mass analyzer and the mass analyzer is typically pumped out to provide a vacuum environment before the sample at each spot is analyzed. The MALDI technique requires that a pulse from a laser irradiate the matrix and causes it to evaporate. The sample is carried with the matrix, ionized, and analyzed by the mass analyzer. Loading a sample plate into a mass analyzer and subsequently pumping the vacuum pressure mass spectrometer down to a pressure at which analysis can take place, typically takes several minutes.

Typically, operators handle the sample plate in a vertically orientated position, this vertical position being the position in which the sample plate is orientated when subjected to radiation by a laser. This orientation is not considered by operators to be natural, and consequently, in order to enable stable manual loading of the sample plate the sample plate is presented horizontally thus allowing a user to load and unload the sample plate with only one hand.

In addition, existing MALDI sample plate handling systems typically experience situations in which the sample plate exchange becomes jammed, stuck, dropped or lost. This is particularly the case for systems that utilize electromechanical or pneumatic gripping mechanisms which may lose contact with or disengage the sample plate due to power loss.

The sample plates are handled in an atmospheric environment, but prior to analysis are required to reside in a vacuum chamber of a mass analyzer, so mechanisms to pick the sample plate up and deliver the sample plate to the vacuum chamber are required. In addition, mechanisms are required to ensure that the sample plate can be positioned within the mass analyzer in a manner that is reliably repeatable. That is, in a manner that can be repeated such that one can be assured a sample plate is being positioned at the same location within the mass analyzer each time.

Sample plate delivery systems typically utilize at least two such mechanisms to accommodate the fact that the sample plate is picked up from an environment that is at atmospheric pressure and is required to be transferred through different pressure regions before arriving in the vicinity of vacuum chamber of mass analyzer. The mechanisms generally have fingers or a fork that grasp the sample plate along at least one edge of the sample plate, and may be robotic. But most have an additional adapter attached to accommodate the automated hand-off. Most vacuum sample plate systems use a drop stage and two stationary actuators to move a sample plate into a vacuum chamber. This transfer process provides room for error in reliability of repeatability, in that the position of the sample plate is not fixed along any axis throughout the process.

SUMMARY

This invention provides for improvements to the manner in which sample plates are manipulated prior to being analyzed by a mass analyzer. This invention provides methods and apparatus for manipulating a sample plate from the exterior of a mass analyzer to a low pressure chamber in the vicinity of the mass analyzer in a manner that is reliably repeatable. This invention also allows the vacuum chamber of a vacuum pressure mass analyzer to be maintained at its desired vacuum pressure without being adversely affected by the loading and unloading of the sample plate into the instrument, as well as avoiding being contaminated by the atmosphere sounding the apparatus.

A new sample plate handling apparatus for use with mass analysis, and methods for use the same have been developed. The sampling plate handling apparatus comprises a sample plate receiver which receives the sample plate in a first plane, a rotating device for rotating the sample plate from the first plane to a second plane, and a relocation device that relocates the sample plate in the second plane such that one of the samples on the sample plate is delivered to the position desired for analysis by the mass analyzer.

The sample plate handling apparatus can accommodate the size and shape of a sample plate, such as a microtitre plate or any other such sample plate, without additional specialized adapters to accommodate either the automation portion or the sample handling process.

Particular implementations can include one or more of the following features. The first plane can be defined by the sample plate, and the second plane can be substantially orthogonal to the first plane. The relocation device can relocate the sample plate such that a beam of radiation that irradiates a sample on the sample plate emanates ionized particles the major or central axis of travel of the ionized particles being substantially aligned with ion transfer optics of the mass analyzer.

The sample plate receiver incorporating a rotating mechanism on a pivoting axis allows numerous sample plate receipt mechanisms to be realized, for example the sample plate receiver may accommodate manual operation, a dynamic or a static robotic drop tray. In addition the sample plate receiver may be easily converted to accommodate one or the other of the above.

Unless otherwise defined, all technical and scientific terms used herein have the meaning commonly understood by one of ordinary skill in the art to which this invention belongs. In the case of conflict, the present specification, including definitions, will control. Unless otherwise noted, the terms "include", "includes" and "including", and "comprise", "comprises" and "comprising" are used in an open-ended sense—that is, to indicate that the "included" or "comprised" subject matter is or can be a part of component of a larger aggregate or group, without excluding the presence of other parts or components of the aggregate or group. The terms "upper" and "lower" are used to denote position relative to the two guidance structures and are not intended to refer to different parts of the structure. The details of one or more implementations of the invention are set forth in the accompanying drawings and the description below. Further features, aspects, and advantages of the invention will become apparent from the description, the drawings, and the claims.

BRIEF DESCRIPTION OF THE DRAWINGS

FIG. 1 is a schematic depiction of a MALDI mass spectrometer.

FIG. 2 is a overall isometric front view of a mass analyzer incorporating a sample plate handling apparatus according to the present invention.

FIGS. 3*a* to 3*h* depict a detailed embodiment of a sample plate handling apparatus according to the present invention for loading and unloading a sample plate into a mass analyzer.

Like reference numerals refer to corresponding parts throughout the several views of the drawings.

DETAILED DESCRIPTION OF EMBODIMENTS

Figure 3E:
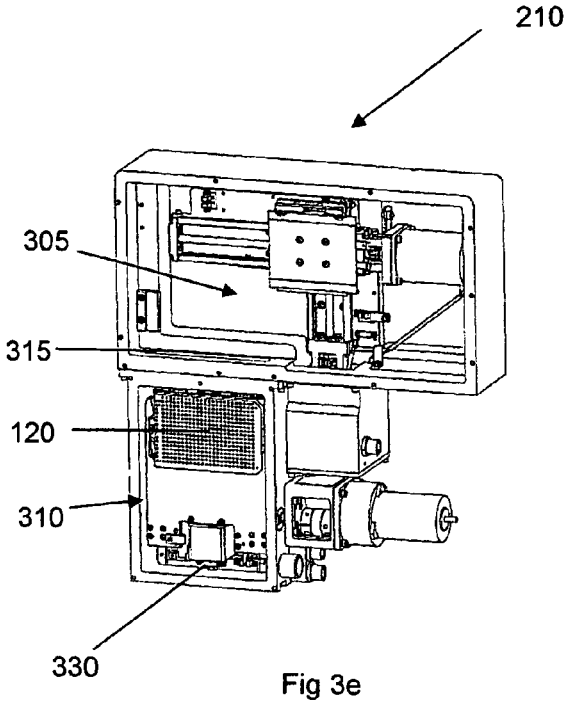

This invention is not limited to the particular embodiments described herein. There are a number of varied embodiments and these variations can be made by a person competent in the art and are therefore considered to be covered by the invention.

An overall configuration of a MALDI mass spectrometer (MS) system 100 is illustrated schematically in FIG. 1. As illustrated, a radiation source 105 is positioned to direct a beam of radiation 110 onto a sample spot 115 deposited on a sample plate 120. The sample plate holder 125 is mounted on a computer-controlled positioning mechanism, such as an X-Y stage, to determine a selected sample position on each sample plate and aligns the radiation spot (the impingement area of the radiation beam 110) with that selection position on the sample plate 120. The sample plate holder 125 is typically positioned in the X-Y plane (the plane defined by the sample plate 120) by means of stepper motors or similar actuators/drivers, the operation of which is precisely controlled by signals transmitted from a controller 130. In alternate configurations, alignment of the radiation spot with a selected region of sample plate 120 may be achieved by maintaining the sample plate 120 stationary and steering radiation beam 110 by moving the radiation source 105 or mirrors of other optical elements disposed in the radiation beam path.

Ions produced via absorption of the radiation beam energy at the sample spot 115 traverse the ion transfer optics 135. The ion transfer optics 135 may include various ion guides or ion optical elements, for example any suitable one or combination of RF multipole guides, tube lenses, ion tunnels comprising a plurality of RF electrodes having apertures through which ions are transmitted, and/or aperture plate lenses/differential pumping orifices. The ions then traverse one or more orifice plates or skimmers 140 into a vacuum pressure mass analyzer 145 for measurement of the ions' mass-to-charge ratios. The vacuum pressure mass analyzer 145, which is located in a high-vacuum chamber, may take the form, for example, of a TOF analyzer, quadrupole analyzer, ion trap, FT/ICR analyzer or an electrostatic trap analyzer such as the ORBITRAP™ manufactured by Thermo Finnigan LLC. Typically, the ions will pass through one or more chambers of successively lower pressures separated by orifice plates or skimmers, the chambers being differentially pumped to reduce total pumping requirements.

Some or all of the components of the MS system 100 can be coupled to a processing unit 165, such as an appropriately programmed digital computer system, which receives and processes data from the various components and which can be configured to perform analysis on the data received.

In the configuration illustrated above, the radiation source 105 is typically a horizontally orientated source, and to enable the radiation beam 110 to impinge the sample plate 120, the plane of the sample plate 120 itself is vertically orientated, or orthogonal to the axis of the ion transfer optics 135. For this reason, operators are typically required to handle sample plates in a plane that is orthogonal to the axis of the ion transfer optics 135.

However, operators of such MALDI MS systems 100 prefer to handle sample plates in a plane that is substantially orthogonal to the plane in which the sample plate 120 is typically orientated whilst it is subjected to a radiation beam 110. Typically, operators are more comfortable placing a sample plate 120 in a controlled manner into a horizontally orientated slot, in a manner similar to which microtitre plates are placed on a laboratory bench, rather than to place a sample plate 120 into a vertical slot, the manual positioning of the sample plate 120 being more natural and easily achieved when the sample plate 120 is in a horizontal orientation.

In addition, automation of such MALDI MS systems 100 in the laboratory can be facilitated in an easier fashion if the sample plate is in a horizontal orientation prior to delivery to the mass analyzer. This invention provides a method and an apparatus to facilitate this preference.

An overall isometric view of a mass analyzing system 200 incorporating a sample plate handling apparatus 210 according to one aspect of the present invention is illustrated in FIG. 2. As shown, mass analyzing system 200 includes a vacuum pressure mass analyzer 145 and a sample plate handling apparatus 210. The sample plate handling apparatus 210 is shown here as an appendage to the vacuum pressure mass analyzer 145, but in other configurations may be partially or fully integrated into the vacuum pressure mass analyzer 145.

The sample plate handling apparatus 210 has a sample plate receiver 220 for receiving a sample plate 120 (not shown) in a first plane (defined by the major axes of the sample plate 120, for example the x and z axes, typically the loading position of the sample plate). The sample plate 120 may be any conventional sample plate 120, typically comprising a thin, substantially rectangular plate of stainless steel or other suitable material. The sample plate 120 typically comprises a plurality of sample areas on one surface of the sample plate 120, areas on which sample solution may be supported and subsequently vaporized. The sample plate 120 may alternatively comprise another type of plate such as microtitre plates, slides, biochips, microscope slides or any other such MALDI sample plate that may store samples.

The sample plate handling apparatus 210 provides means by which the sample plate 120 may be rotated from a first plane to a second plane, the first plane typically being defined by the major axes of the sample plate 120 (the x and z axes as illustrated, typically the plane orthogonal to the axis of the ion transfer optics 135), and the second plane being substantially orthogonal to the plane of the sample plate 120 (the x and y axes as illustrated). The sample plate 120 is subsequently delivered to a desired location in the vicinity of the ion transfer optics 135 so that sample on the sample plate 120 may be ionized and pass into the vacuum pressure mass analyzer 145.

FIGS. 3*a* to 3*h* illustrate more detailed views of a sample plate handling apparatus 210 according to an aspect of the invention. FIGS. 3*a* to 3*d* are illustrative of the sample plate handling apparatus 210 from the operator's perspective, from the outside of the apparatus. FIGS. 3*e* to 3*h* are illustrative of the sample plate handling apparatus 210 from the inside of the apparatus (hidden from the operator). As shown in FIG. 3*e* the sample plate handling apparatus 210 described herein is a two chamber system, though further chambers may be utilized if necessary. One of the chambers is the pressure chamber 305 which is coupled to a vacuum chamber of the vacuum pressure mass analyzer 145. The other chamber is a transition chamber 310 which is configured to couple via a gate 315 to the pressure chamber 305. The transition chamber 310 may be configured to vent to atmospheric pressure and isolated from the pressure chamber 305, or coupled to the pressure chamber 305 and isolated from the atmosphere. The transition chamber 310 may be pumped such that its pressure is substantially the same as that in the pressure chamber 305, or vented such that achieve a pressure substantially the same as the atmosphere in which it resides. The function of the transition chamber 310 is to vent and achieve vacuum pressure before introducing the sample plate 120 into the pressure chamber 305. In this particular implementation, both chambers share common x-axis coordinates and are located along the y axis.

Returning to FIG. 3*a*, the sample plate receiver 220 (not shown) includes a transfer mechanism 325 illustrated in this embodiment in the form of an arm at one end of which a first sample plate griping mechanism 320. The first sample plate gripping mechanism 320 is configured to facilitate gripping of the sample plate 120 without causing unnecessary distress to the sample plate 120 itself or the samples thereon. The first sample gripping mechanism 320 may be any gripping mechanism known in the art, a magnetic means, for example, that when activated facilitates gripping of the sample plate to occur. The sample plate receiver 220 is able to guide the sample plate 120 into the first sample plate gripping mechanism 320 via the operator or a robotic manipulator. The transfer mechanism 325 in FIG. 3*a* is in its extended form, however once the sample plate 120 has been gripped, the transfer mechanism 325 takes its unextended or retracted form, as illustrated in FIG. 3*b*, in which the sample plate 120 is shown retracted by the first sample plate gripping mechanism 320. Electrical sensors (not shown) define the extension and retraction limits of the first sample plate gripping mechanism 320. In an embodiment of the invention, the sample plate receiver 220 itself may have a means to determine if the first sample plate gripping mechanism 320 has gripped a sample plate 120 or if the sample plate 120 is properly engaged prior to commencing retraction of the sample plate gripping mechanism 320 via the arm.

The rotating device 330 rotates the sample plate 120 from the first plane 336 (defined by the x and z axes) to the second plane 337 (defined by the x and y axes) as illustrated in FIGS. 3*c* and 3*d*. The x, y and z axes are for illustrative purposes, and are not intended to be limiting. This rotation may be accomplished by rotating the first sample plate gripping mechanism 320 from a first to a second position, such that the plane of the sample plate 120 is rotated about a pivot axis 335 from a first plane 336 (x-z) to a second plane 337 (x-y), the angle of rotation being about ninety degrees such that the second plane is substantially orthogonal to that of the first plane. The pivot axis 335 is defined as the axis along which the first and second planes, 336 and 337 respectively, intersect. Alternative rotation mechanisms are within the scope of this invention. The rotating device 330 rotates the sample plate 120 into the transition chamber 310 of the sample handling apparatus 210.

Once rotated into the x-y plane, the sample plate 120 is transferred by the transfer mechanism 325 to a relocation device 340, as illustrated in FIGS. 3*e* to 3*h*. In one implementation transference of the sample plate 120 may occur through mechanical means of exchange in which the motion of the sample plate 120 is restricted in the y-axis, and appropriately positioned in the x-axis for the second sample plate gripping mechanism 345 to grip it.

The relocation device 340 resides in the pressure chamber 305 and is responsible for positioning the sample plate 120 such that the impingement of the beam of radiation 110 is aligned with a select region of the sample plate 120, such that the major or central axis of the direction of travel of the ions emanating therefrom substantially align with the ion transfer optics 135 of the vacuum pressure mass analyzer 145. In one implementation, the relocation device 340 comprises the X-Y stage 350 only. In another implementation the relocation device 340 takes the form of a second sample plate gripping mechanism 345 that is mounted onto a corresponding X-Y stage 350 as known in the art which relocates the sample plate 120 in the pressure chamber 305, in a plane that is typically substantially parallel to the x and y axes and orthogonal to the ion transfer optics 135. The second sample plate gripping mechanism 345 may comprise a sample grip system similar to the first sample plate gripping mechanism 320, or comprise another sample grip mechanism 345 such a magnetic means or other such means known in the art. The magnetic means, for example, when actuated, would be responsible for holding the sample plate 120 until the magnetic means was de-actuated. Alternatively, the second sample plate gripping mechanism may comprise a mechanism as described in co-pending U.S. patent application entitled "Sample Plate Gripping Mechanism".

The X-Y stage 350 may be driven by vacuum compatible stepper motors within the pressure chamber 305 such that the precision of the motors enables the required alignment and exhibits the lowest alignment error possible, as opposed to motors placed outside the vacuum chamber. This allows for a reliable X-Y stage. The X-Y stage typically includes two actuators that position the sample plate 120 in front of the ion transfer optics 135, the entrance into the vacuum pressure mass analyzer 145.

Some or all of the components of the apparatus 210 may be coupled to controller 130, such as an appropriately programmed processing unit 165, which receives and processes data from the various components and which may be configured to operate the system as desired. In particular, computer control of the stepper motors of the X-Y stage 350 may allow any selected point on the sample plate 120 to be positioned typically within a fraction of a millimeter, for example +/−3 microns, and irradiated by the beam of radiation 110 such that the major or central axis of travel of the ionized particles is substantially aligned with the ion transfer optics 135 of the vacuum pressure mass analyzer 145, and some of the ionized particles may enter the vacuum pressure mass analyzer 145 for analysis.

Figure 4:
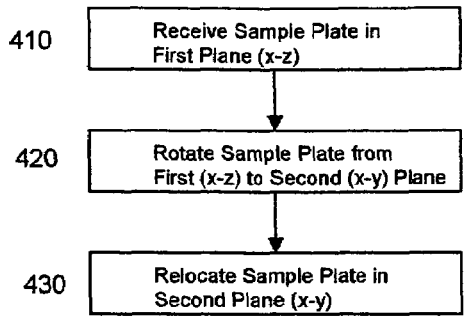
FIG. 4 is a flow diagram depicting the steps of a method for manipulating a sample plate in accordance with an aspect of the invention.

A method of the invention as illustrated in FIG. 4 comprises a series of steps to manipulate a sample plate 120 into a vacuum pressure mass analyzer 145, the steps being such that the plane of the sample plate 120 is rotated from a first to a second plane, and subsequently relocated in the second plane.

The steps of the method for manipulating a sample plate to be analyzed by a mass analyzer may include receiving the sample plate 120 in the first plane (step 410), the first plane being the plane of the sample plate 120 itself (x-z plane 336); rotating the sample plate 120 from the first to the second plane (step 420), the second plane typically being substantially orthogonal (x-y plane 337) to the first; and relocating the sample plate 120 in the second plane (step 430), the relocation typically being such that impingement of the beam of radiation 110 on a selected sample spot 115 facilitates the major or central axis of the direction of travel of the ionized particles to be substantially aligned with the ion transfer optics 135 of the vacuum pressure mass analyzer 145.

Figure 5:
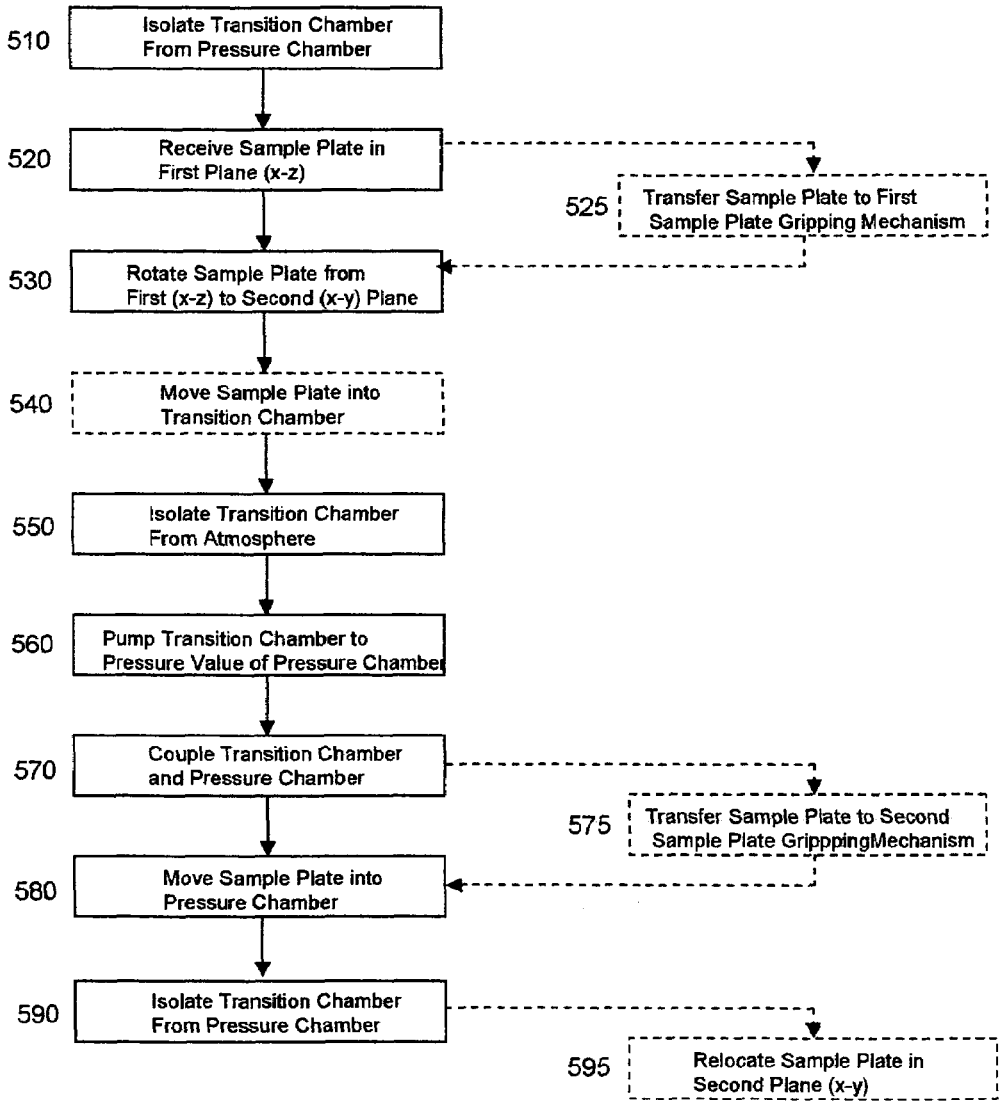
FIG. 5 is a flow diagram depicting the steps of a method for manipulating a sample plate in accordance with another aspect of the invention.

A more detailed implementation of the invention is described in relation to FIGS. 3*a* to 3*h* and FIG. 5. FIG. 5 comprises a series of steps to load a sample plate 120 into a vacuum pressure mass analyzer 145, the steps being such that the plane of the sample plate 120 is rotated from a first 336 to a second plane 337, and subsequently relocated in the second plane 337, the sample plate 120 traversing a transition chamber for transferring the sample plate 120 between the sample plate receiver 220 and the vacuum chamber 305 of the vacuum pressure mass analyzer 145 whilst minimizing any variation in the pressure in the vacuum chamber of the vacuum pressure mass analyzer. An advantage offered by this method is that the vacuum pressure mass analyzer 145 remains at vacuum throughout the process of loading the sample plate 120. FIGS. 3*a* to 3*h* illustrate a sample plate apparatus operating as described by the method of FIG. 5, at various steps of the operation sequence.

Initially, before the sample plate 120 is loaded into the sample plate receiver 220, the transition chamber 310 is isolated from the pressure chamber 305 (step 510) typically by closing the gate 315 between the transition chamber 310 and the pressure chamber 305. The transition chamber 310 comprises a vent valve which when opened allows the pressure to be raised to the desired value. The transition chamber 310 is initially raised to a first pressure value, that value typically being atmospheric pressure; the pressure chamber 305 is typically held at a small pressure value such as 10 millitorr; and the gate 315 is closed. This isolation allows the vacuum chamber of the vacuum pressure mass analyzer 145 to be maintained at its desired vacuum pressure without being adversely affected by the loading and unloading of the sample plate 120 into the sample plate receiver 220, as well as avoiding being contaminated by the air surrounding the instrument.

When the sample plate 120 is received by the sample plate receiver 220 (step 520, FIG. 3(*a*)), the sample plate 120 is in a first plane 336, typically the plane of the sample plate 120 being defined by the x and z axes. Receipt of the sample plate 120 may be accomplished by manual insertion of the sample plate by the user, or by adding a robotic feature that implements this function.

In one implementation the user places the sample plate 120 guided by the sample plate receiver 220 directly into a first sample plate gripping mechanism 320 that is at one end of the transfer mechanism 325. The first sample plate gripping mechanism 320 is then retracted by the transfer mechanism 325 into the sample plate receiver 220, as illustrated in FIG. 3*b* via retraction of the first sample plate gripping mechanism 320. In another implementation, the sample plate 120 may be placed into a tray in the sample plate receiver 220 and subsequently the sample plate 120 may be transferred to a first sample plate gripping mechanism 320 (step 525). In yet another implementation, the tray may be the first sample plate gripping mechanism 320. In an alternative implementation, the first sample plate gripping mechanism 320 may comprise a mechanical, magnetic or other such holding means that is caused to securely grip the sample plate 120 when actuated, and release the sample plate 120 when de-actuated. In yet a further implementation, the sample plate gripping mechanism 320 may be a mechanical spring with a biasing element locking on a detent.

In order to ensure that a subsequent sample plate 120 is not inserted into the system whilst one is actually carrying out analysis of the first sample plate 120, it may be useful to incorporate a latch or other such means that prevents the insertion of multiple sample plates into the sample plate receiver 220. In one implementation this latch may be used to disengage the sample plate 120 from the sample plate gripping mechanism 320 into the tray or sample plate receiver 220 so that the sample plate is free for pick-up by the user. The latch can be activated by the rotating motion of the rotating device 330 via levering a rotational cam underneath the latch. The cam is rotated to either lock the latch or disengage the latch and can be equipped with a solenoid, thus being activated electromechanically.

Once gripped by the first sample plate gripping mechanism 320, the sample plate 120 is rotated from the first plane 336 (defined by the x and z axes) to the second plane 337 (defined by the x and y axes) in step 530, FIGS. 3*c* and 3*d*. This rotation may be accomplished by rotating the first sample plate gripping mechanism 320 from a first to a second position, such that the plane of the sample plate 120 is rotated about a pivot axis 335 from a first plane 336 (x-z) to a second plane 337 (x-y), the angle of rotation being about ninety degrees such that the second plane is substantially orthogonal to that of the first plane. Alternative rotation mechanisms are within the scope of this invention. This rotation may move the sample plate 120 into the transition chamber 310 if it does not, a step (540) may be required to accomplish this.

In one implementation rotation of the first sample plate gripping mechanism 320 from the first to the second position (step 530), may cause the transition chamber 310 to be sealed or isolated from the atmosphere. This may be facilitated by use of an o-ring type structure or gate. Alternatively a subsequent step may be required to attain this required sealing step (step 550).

At this point, the transition chamber 310 should already be isolated from the pressure chamber 305, such that substantially no coupling occurs between the two chambers. The transition chamber 310 comprises a pump valve (not illustrated) that is closed so that the transition chamber 310 can be pumped out until the pressure value in the transition chamber 310 substantially equals the pressure value in the pressure chamber 305 (step 560). Once the pressure value of the transition chamber 310 has reached the equalization value, the gate 315 between the transition chamber 310 and the pressure chamber 305 is at least partially opened in step 570, FIG. 3*e*, so that the two regions are now coupled, and air from one chamber may flow to the other chamber. The sample plate 120 is moved by the transfer mechanism 325 in the y direction, in a plane that is substantially parallel to the x and y axes (337), such that it is now located in the pressure chamber (step 580, FIG. 3*f*).

Figure 3F:
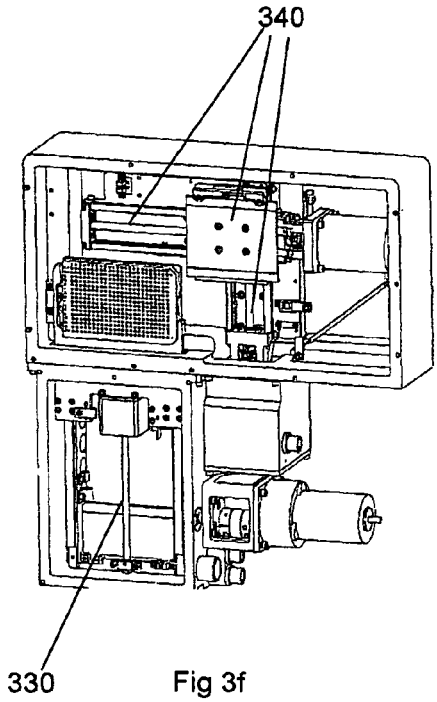
Figure 3G:
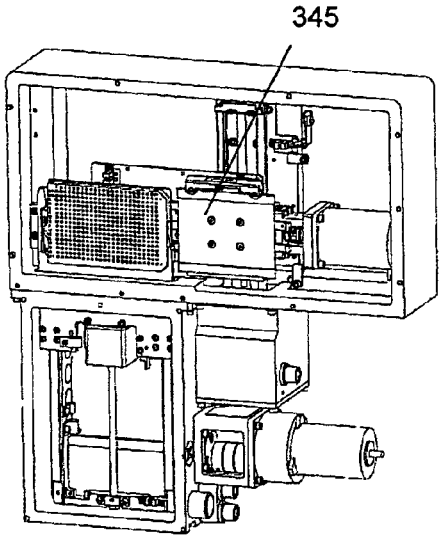
Figure 3H:
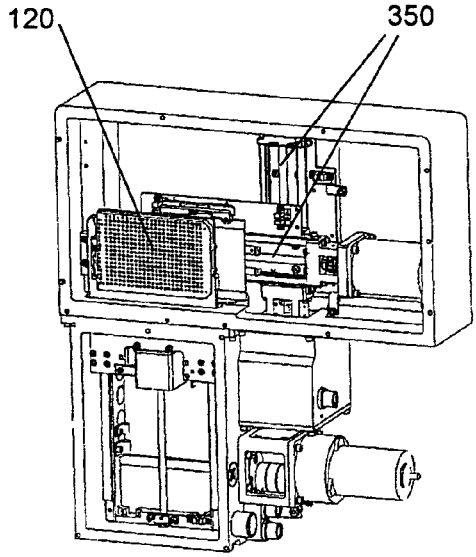

In one implementation, this step may be accomplished by relocating the first sample plate gripping mechanism 320 from the transition chamber 310 to the pressure chamber 305 (step 575, FIG. 3*f*). This effectively transfers the sample plate 120 from the transition chamber 310 to the pressure chamber 305. The sample plate 120 may then be transferred from the first sample plate gripping mechanism 320 to the second sample plate gripping mechanism 345. As indicated earlier in one implementation transference of the sample plate 120 may occur through mechanical means of exchange in which the motion of the sample plate 120 is restricted in the y-axis, and appropriately positioned in the x-axis for the second sample plate gripping mechanism 345 to grip it. In this implementation motion of the sample plate 120 in the y-axis is not restricted.

Once the sample plate 120 has been transferred to the pressure chamber 305, the first sample plate gripping mechanism 320 may be retracted once again into the transition chamber 310, and the gate 315 once again closed, this isolates the transition chamber 310 from the pressure chamber 305 (step 590). Once isolated, the pressure chamber 305 may if need be, be pumped out until it reaches a pressure that is substantially equal to the pressure of the vacuum chamber of the vacuum pressure mass analyzer 145, or at least to a pressure of one of the chambers leading up to the vacuum chamber of the vacuum pressure mass analyzer 145, or such that the vacuum chamber pressure is substantially the same.

The sample plate 120 may then, if required, be relocated (step 595) such that the major or central axis of travel of the ionized particles that emanate from the sample spot 115 is substantially aligned with the ion transfer optics 135 of the vacuum pressure mass analyzer 145, and a portion of the ionized particles enter the vacuum pressure mass analyzer 145 for analysis.

The relocation (step 595) may be achieved by means of the X-Y stage 350, as known by those with skill in this art. The extent of motion of the X-Y stage 350 is limited by sensors. The first X-Y position is typically the "home" position of the sample plate 120, the position at which calibration initiates, calibration to take into consideration x-y motion error. Once calibration has occurred, the sample plate 120 is ready to be used and the samples are ready to be analyzed. Ionized particles can now pass to the ion transfer optics 135 of the mass analyzer 145. Once the sample spots on the sample plate 120 have been analyzed, the steps of the method identified above are repeated in the reverse order and the sample plate 120 removed from the sample plate receiver 220. Another sample plate 120 is then inserted and the methodology applied again for analysis of the other sample plate 120.

Figure 6:
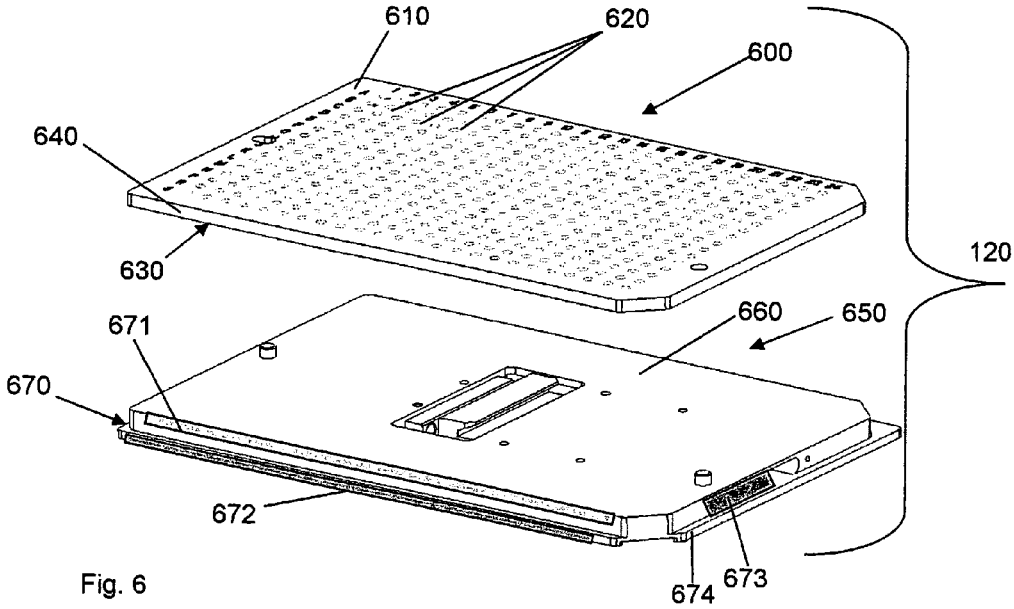
FIG. 6 is an exploded view of a sample plate and a sample plate adapter, as used in mass spectrometry applications.
Figure 7:
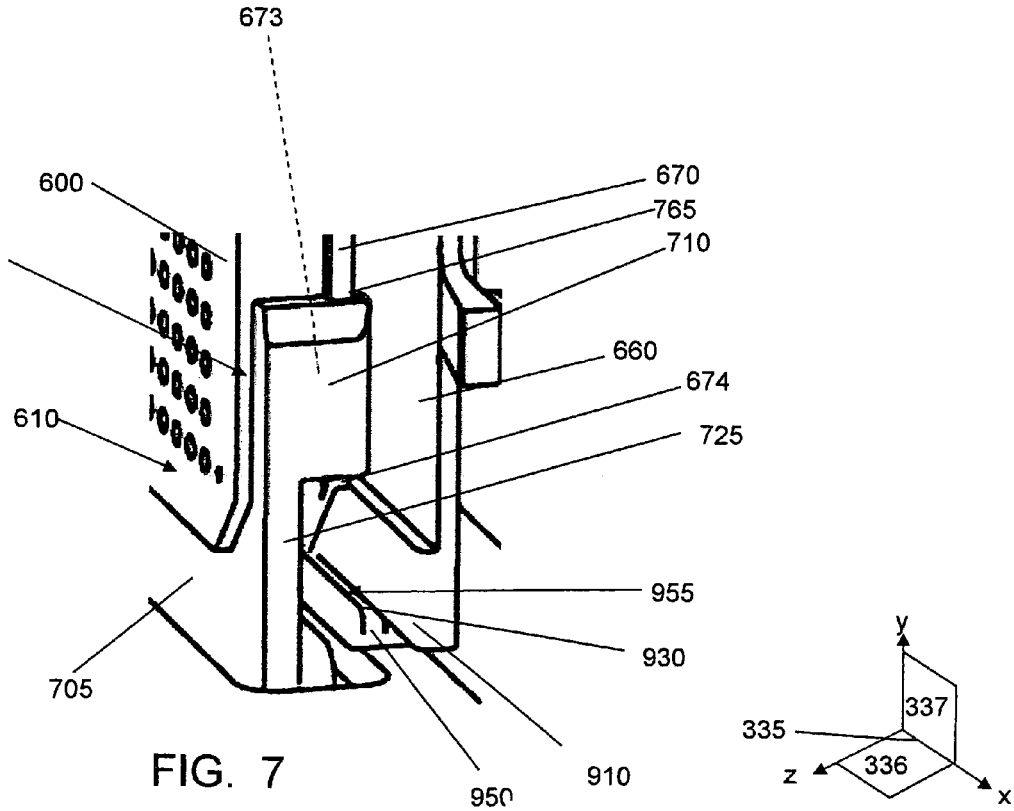
FIG. 7 is a schematic illustration of one prong of a first sample plate gripping mechanism.
Figure 8:
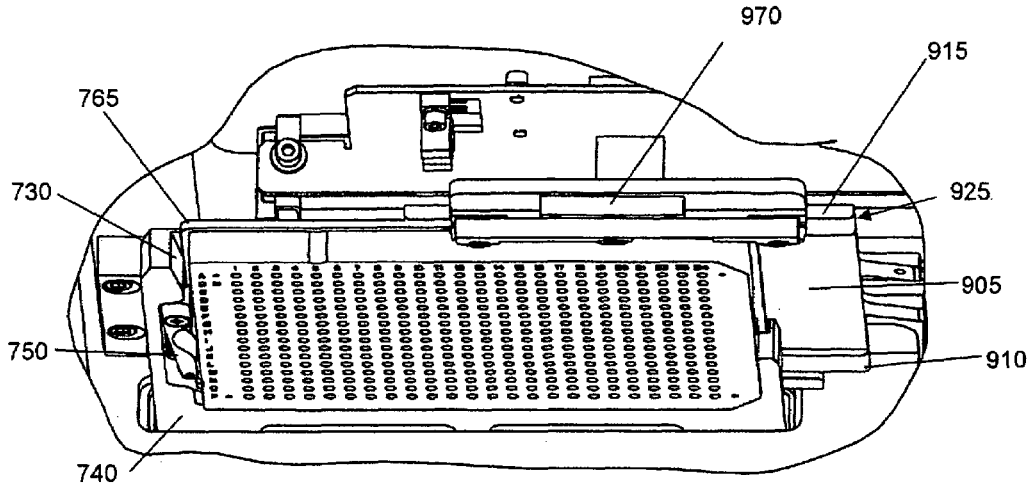
FIG. 8 is a top perspective view in schematic form illustrating both a sample plate body being gripped by both a first and a second sample plate gripping mechanisms.
Figure 9:
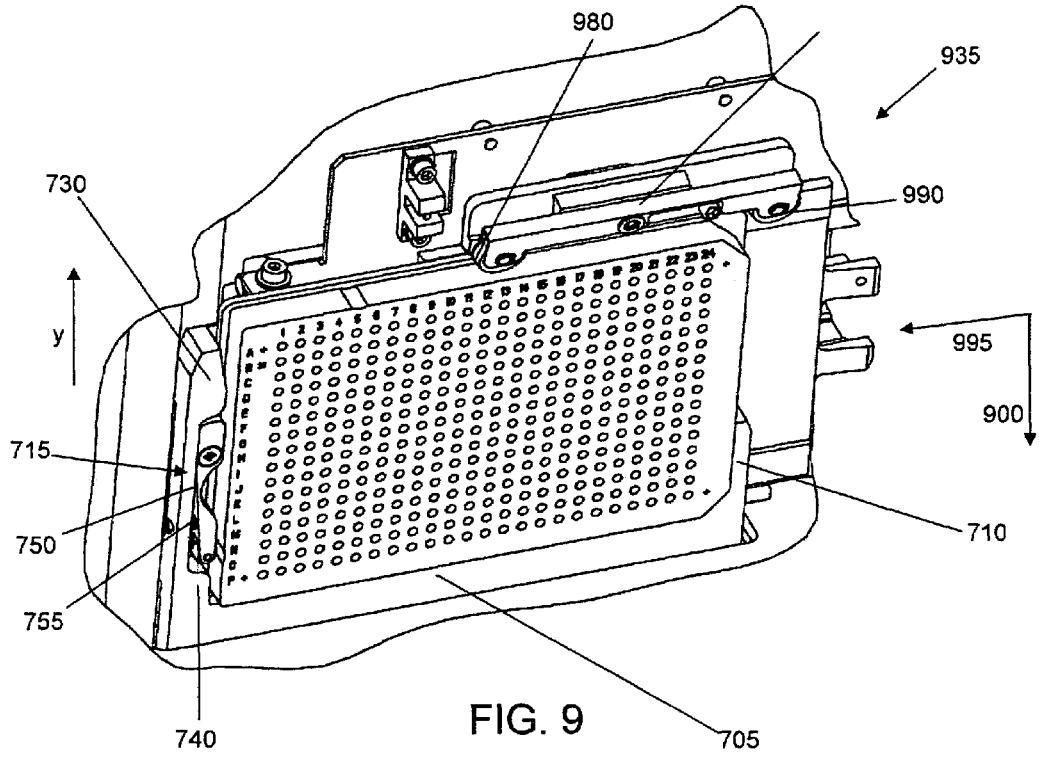
FIG. 9 is a perspective view in schematic form illustrating a sample plate body being gripped by both a first and a second sample plate gripping mechanisms.

Details of the particular implementations of gripping mechanisms are illustrated in FIGS. 7 to 9. These three figures illustrate different views in which the sample plate 120 is being simultaneously gripped by both the first and the second sample gripping mechanisms 320 and 345 respectively. In order to better understand the working of these structures a description of a typical sample plate 120 is required. A typical sample plate 120 is illustrated in FIG. 6.

FIG. 6 illustrates a MALDI sample plate body 600 and a sample plate adapter 650, which together form a typical sample plate 120. The sample plate body 600 is typically made of stainless steel or some other suitable material, and has a top surface 610 having a plurality of sample areas 620 on which sample spots are deposited, and bottom surface 630 opposite to the top surface 610. The bottom surface 630 of the sample plate body 600 is designed to come into contact with the platform 660 of the sample plate adapter 650 to form the MALDI sample plate 120. The sample plate body 600 has substantially parallel surfaces 610, 630 and a peripheral surface 640. The MALDI sample plate 120 is formed by releasably attaching the sample plate body 600 to the sample plate adapter 650. When attached, the sample plate adapter 650 forms a lip 670 where the sample plate adaptor 650 extends beyond the perimeter of the sample plate body 600 or beyond the platform 660 of the sample plate adapter 650 (whichever is the larger). The lip 670 enables alignment of the sample plate to be attained. As illustrated, the lip 670 has some depth to it, the depth being the width of the contact surface 672 (described later). The depth of the lip forms a perimeter surface comprising two lateral and two peripheral surfaces. In order to aid in understanding the operation of the gripping mechanisms, certain contact areas are indicated as shaded areas, namely those indicated by reference numbers 671, 672 and 673. These contact areas indicate certain areas where contact is made with the gripping mechanism, and do not indicate any existence of specific structure. The purpose of the contact areas 671, 672 and 673 will be explained later.

The sample plate body 600 and the sample plate adapter 650 are releasably coupled in a manner that inhibits the movement of the sample plate body 600 relative to the sample plate adapter 650, the sample plate adapter 650 exerting a downward force on the sample plate in a direction orthogonal to the plane of the sample plate body 600.

FIG. 6 and associated text depict/describe one non-limiting example of a sample plate 120 that can be used with this invention. For example, the sample plate 120, although illustrated as two distinct components, the sample plate body 600 and the sample plate adapter 650, may comprise a single body, a combination of these two element manufactured one discrete component, such as a microtitre plate.

Referring now to FIGS. 7 to 9, the first sample plate gripping mechanism 320 comprises a fork-like arrangement, the fork having an element 705 and two prongs 710 and 715 as shown in FIG. 9. The element 705 serves to support and retain the upper lateral peripheral surface of the sample plate adapter 650. The support provided is primarily along the upper lateral peripheral surface, primarily along the contact area 671 of the sample plate adapter 650, and does not include support along the peripheral surface of the lip 670, (illustrated by the shaded area 672) of the sample plate adapter 650.

The first prong 710 is illustrated in greater detail in FIG. 7, in which it can be seen that the first prong 710 guides a portion of the lip 670. The guide provided by the first prong 710 in this implementation is in a U-shape. Once guided, a peripheral area of the sample plate adapter platform 660, is forced via the biasing mechanism 755 to come into contact with and retain the sample plate 100 in the area contact area 673. The first prong 710 is connected to the element 705 via an extension 725, but this extension is found only on the portion of the prong 710 that is close to the top surface 610 of the sample plate body 600. There is no extension formed from the portion of the first prong 710 that grips the lip 670 to the element 705, in a direction away from the top surface 610 of the sample plate body 600. Therefore forming a clearance path to the lateral peripheral surface of the lip 670 of the sample plate 120.

The second prong 715 serves as a guide comprising of a constructed U-shape which is formed surrounding the lip 670. The constructed U-shape is comprised a retaining portion 765, a first and a second protrusion 730 and 740 respectively, and a retaining element 750. The retaining element 750 comprises a biasing mechanism 755, such as a levered spring with the biasing mechanism having a roller. The inner edges (the ones closer to the sample plate) of first and second protrusions 740 and 750 respectively are in line and form a surface plane which loosely guides the sample plate 120. In operation, the sample plate 120 is initially not in contact with any area of the second prong 715, but when moved in a direction as indicated by the arrow 900, begins to be guided by and eventually contact areas of the second prong 715. The leading or upper edge of the first protrusion 730, which is the first edge to be approached by the sample plate 120, is chamfered to aid in alignment of the sample plate 120. As the sample plate continues in the direction of the arrow 900, the lip 670 on the opposite side of the sample plate adaptor 650 to the contact area 674 is guided by the constructed U-shape. As the sample plate continues in the direction 900, the retaining element 750 comprising the biasing mechanism 755 forces the sample plate 120 towards the element 705 and the first prong 710, but not before the prong 710 is engaged. As the sample plate 120 continues in the direction 900, the chamfered upper edges of the first prong 710 aid in guiding the sample plate 120 further, and the peripheral surface of the lip 670 is gripped in the region of contact area 673. The sample plate 120 is guided in and eventually the element 705 makes contact with the contact area 671, the lateral peripheral surface of the platform 660 of the sample plate adapter 650.

At this point, the sample plate adapter 650 makes contact via the portion of the lip 670 extending between the first prong 710 and the second prong 715, and retains the sample plate adapter 650 between contact area 763 and the biasing mechanism 755. At this point, the sample plate is held loosely guided in the U-shape in the first prong 710 and the constructed U-shape in the second prong 715. There is no contact made between the lower portion 674 of the peripheral surface of the lip 670 and the first prong 710; and no contact made between the element 705 and the peripheral surface of the lip (the exposed peripheral surface of the lip) identified by contact area 672. The insertion into the first and second prongs 710, 715 is stopped when the element 705 and the lateral peripheral surface identified by 671 are in contact with one another.

The second sample plate gripping mechanism 345 comprises a planar member 905 having opposed lateral peripheral surfaces 910, 915 and end peripheral surfaces 920, 925. A first guiding structure 930 is disposed along one lateral peripheral surface 910, and a second guiding structure 935 is disposed along the opposing lateral peripheral surface 915. The first and second guiding structures 930 and 935 respectively are spatially positioned on the planar member 905 to accommodate the dimensions of the sample plate 120 and allow the sample plate 120 to be releasably gripped.

The first guiding structure 930 which is illustrated in greater detail in FIG. 7, comprises an L-shaped structure 950 along the lateral peripheral surface 910 of the planar member 905. The L-shaped structure 910 is coupled to the planar member 905 such that the combined structure forms a J-shaped structure along the lateral peripheral surface 910. The J-shaped structure defines a groove 955 which is configured to receive the complimentary portion of the lip 670 formed by the sample plate 120 as illustrated in FIG. 7. The first guiding structure 930 acts as a groove for guiding the lip 670 of the sample plate 120, providing guiding in the x direction.

The second guiding structure 935 comprises a biasing means which is coupled to the planar member 905 and acts as a guiding rail for guiding the other lateral peripheral surface 915 of the sample plate body, providing guidance in at least the x and z directions. The second guiding structure 935 is illustrated in more detail in FIGS. 8 and 9. In one implementation, the biasing mechanism comprises a rocker arm 960 that is coupled via a spacer 970 and suitable coupling means to provide for resilient coupling. This resilient coupling allows for the rocker arm 960 to have freedom of motion in the y and z directions. The rocker arm 960 may comprise stainless spring steel, and may be a weighted rocker arm when in the vertical direction. The second guiding structure 935 may also comprise frictional elements, in the form of blocks, or as illustrated here, in the form of at least two rollers 980, 990, one roller disposed at each of the rocker arm 960. Each roller 980, 990 exhibits a degree of resiliency in the x, y and z directions. In one implementation of the invention, the resiliency is provided in part by configuring the rollers 980, 990 such that the diameter of the rollers 980, 990 is at an angle to the plane of the sample plate 100 as shown in FIGS. 8 and 9. The rollers 980, 990, may have any shape, as to engage a multitude of different corners and edges of the sample plates 120.

In operation, initially, the second sample plate gripping mechanism 345 is not in contact with any portion of the sample plate 120. However, moved in the direction of the arrow 995, the exposed lip area 672 enables the second sample plate gripping mechanism 345 to guide the sample plate 120 by engaging the lower peripheral surface of the lip 670, by sliding the sample plate between the contact area 672 and the groove 955.

As the second sample plate gripping mechanism 345 continues in the direction 995, the first of the two rollers 980 approaches the upper peripheral surface of the sample plate adapter 650. In the event that the circumferential perimeter of the first roller 980 does not align with the upper peripheral surface of the sample plate adapter 650, there are several features that enable the upper lip 670 of the sample plate adapter 650 to be engaged between the first of the two rollers 990 and the planar member 905. Firstly, the resiliency provided by the diameter of the first roller 990 being at an angle to the plane of the sample plate 120. Secondly, the inherent pivotal spring action of the weighted rocker arm 960. Thirdly the resiliency offered by the manner in which the rocker arm 960 is coupled to the planar member 905 via the coupling means 970. The weighted rocker arm 960 allows the first roller 980 to roll or slide in the direction 995, thus compensating for any misalignment of the sample plate 120 in that direction. The angle of the roller 990 combined with the pivot action allows the first roller 990 to move in a direction away from the planar member 905, thus compensating for any misalignment of the sample plate 120 in that direction also. As the second sample plate gripping mechanism 345 continues in the direction 995 the second of the two rollers 990 approaches the upper peripheral surface of the sample plate adapter 650 at which point the pivoting action of the rocker arm 960 is activated by the second roller being pushed up on the sample plate body 600. The second guiding structure 935 thus provides a biasing mechanism both in the plane of and orthogonal to the plane of the sample plate 120, and aids in grasping and leading the sample plate 120 in whilst applying a minimal gripping force, that is a force less than that of the weight of the sample plate 120 itself.

Once gripped by the second sample plate gripping mechanism 345, the sample plate 120 can be moved via an X-Y stage, in the y-direction due to a clearance path provided by the first and second sample gripping mechanisms 320 and 345 respectively. The sample plate is able to be held with a 0.002 inch planarity relative to the ion transfer optics 135 within the travel of the relocation device 340 (the X-Y stage 350). In this manner, precision planarity with the second sample plate gripping mechanism 345 related to the ion transfer optics 135 is maintained.

Figure 10:
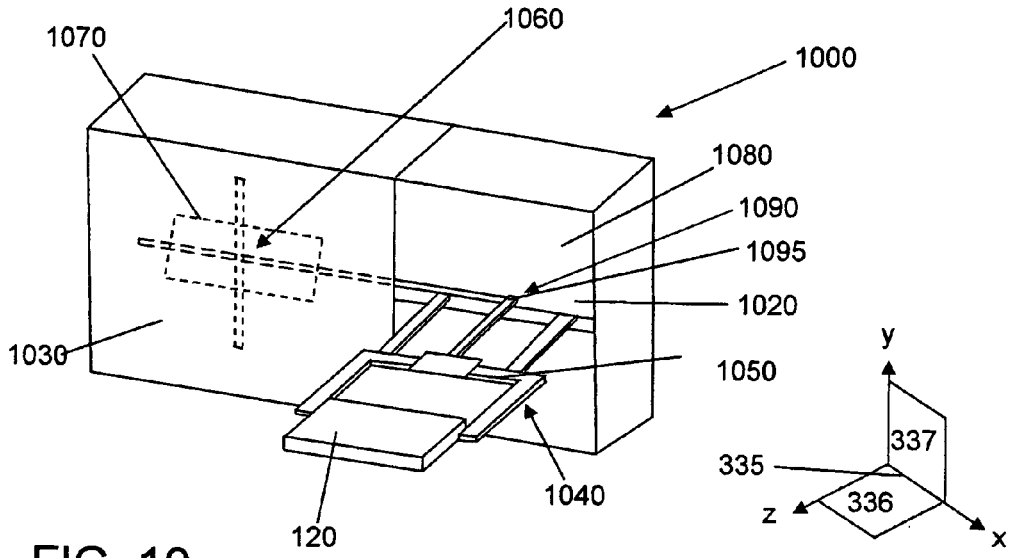
FIG. 10 is a symbolic illustration of a sample plate handling apparatus in an alternative configuration.

FIG. 10 illustrates in symbolic form a sample plate handling apparatus 1000 according to another aspect of the invention. According to this aspect of the invention, the sample plate handling apparatus 1000 is once again a two chamber system, comprising a transition chamber 1020 and a pressure chamber 1030, however the two chambers are displaced from each other along the x axis and share common y axis coordinates. The transition chamber 1020 of the sample plate handling apparatus 900 is configured to couple via a gate 1025 (not shown) to the pressure chamber 1030. The pressure chamber 1030 is in turn coupled to a vacuum chamber of the mass analyzer 145.

The sample plate handling apparatus 1000 has a sample plate receiver 1040 for receiving a sample plate 120 in a first plane (defined by the major axes of the sample plate 120, for example the x and z axes). In one implementation, the sample plate receiver 1040 includes a transfer mechanism at one end of which is the first sample plate gripping mechanism 1050. Once rotated into the x-y plane, the sample plate 120 is transferred from the first sample plate gripping mechanism 1050 to a relocation device 1060. The relocation device 1060 resides in the pressure chamber 1030 and is responsible for positioning the sample plate 120 such that the impingement of the beam of radiation 110 is aligned with a select region of the sample plate 120, such that ions emanating therefrom align with the ion transfer optics 135 of the vacuum pressure mass analyzer 145.

In one implementation, the relocation device 1060 takes the form of a second sample plate gripping mechanism 970 coupled to an X-Y stage 1080. The transfer mechanism extends the first sample plate gripping mechanism 1050 through the gate 1025 and into the pressure chamber 1030. The sample plate 120 is transferred from the first sample plate gripping mechanism 1050 to the second sample plate gripping mechanism 1060. Once transferred, the first sample plate gripping mechanism system 1050 is retracted back through the gate 1025 and into the transition chamber 1020.

Figure 11:
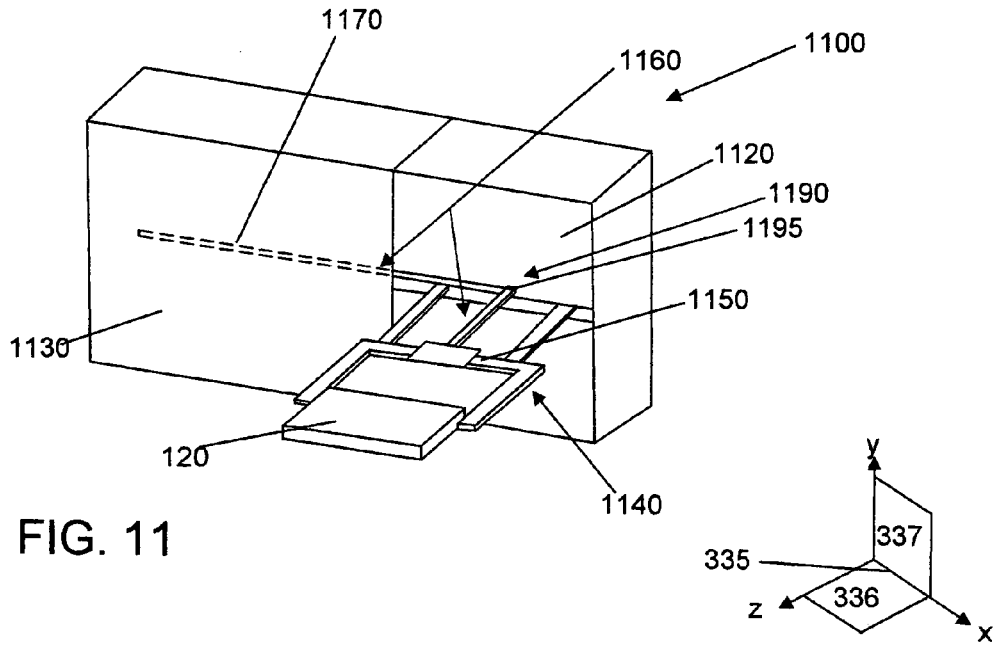
FIG. 11 is a symbolic illustration of a sample plate handling apparatus in yet another alternative configuration.

FIG. 11 illustrates in symbolic form a sample plate handling apparatus 1100 according to yet another aspect of the invention. In this embodiment, the sample plate handling apparatus 1100 has a sample plate receiver 1140 for receiving a sample plate 120 in a first plane (defined by the major axes of the sample plate 120, for example the x and z axes). In one implementation, the sample plate receiver 1140 includes a transfer mechanism at one end of which is the first sample plate gripping mechanism 1150. Once rotated into the x-y plane, the sample plate 120 is transferred by the first sample plate gripping mechanism 1150 directly into the pressure chamber, via the relocation device 1160. The relocation device 1160 resides in the pressure chamber 1130 and is responsible for re-positioning the sample plate 120 such that the impingement of the beam of radiation 110 is aligned with a select region of the sample plate 120, such that ions emanating therefrom align with the ion transfer optics 135 of the vacuum pressure mass analyzer 145.

The transfer mechanism and rotating device for FIG. 11 are as described for FIG. 10 above, however, in this embodiment, once the transition chamber is sealed from the atmosphere, and the gate 1125 is at least partially opened such that the transition chamber 1120 and the pressure chamber 1130 are coupled, no transference is made to a second sample plate gripping mechanism. In this implementation, the relocation device 1160 comprises the first gripping mechanism 1150, an X-stage 1170, and the "Y-stage" is provided by the transfer mechanism that enables the first sample plate gripping mechanism 1150 to be retracted and extended. In this implementation, the relocation device resides not only in the pressure chamber 1130 but also at least partially and/or temporarily in the transition chamber 1120.

The first sample plate is carried through the gate 1125 by the transfer mechanism via the X-stage 1170. Once through the gate 1125, the gate 1125 is closed again. The sample plate can then be moved or relocated via the X-stage 1070 and the transfer mechanism to a location that such that the impingement of the beam of radiation 110 is aligned with a select region of the sample plate 120, and ions emanating therefrom align with the ion transfer optics 135 of the vacuum pressure mass analyzer 145.

A method of the invention illustrated in FIGS. 10 and 11 comprises a series of steps very similar to those illustrated in FIG. 5. The exception for FIG. 11 is that step 575 is not required, as there is no transfer made to a second sample plate gripping mechanism.

Figure 12:
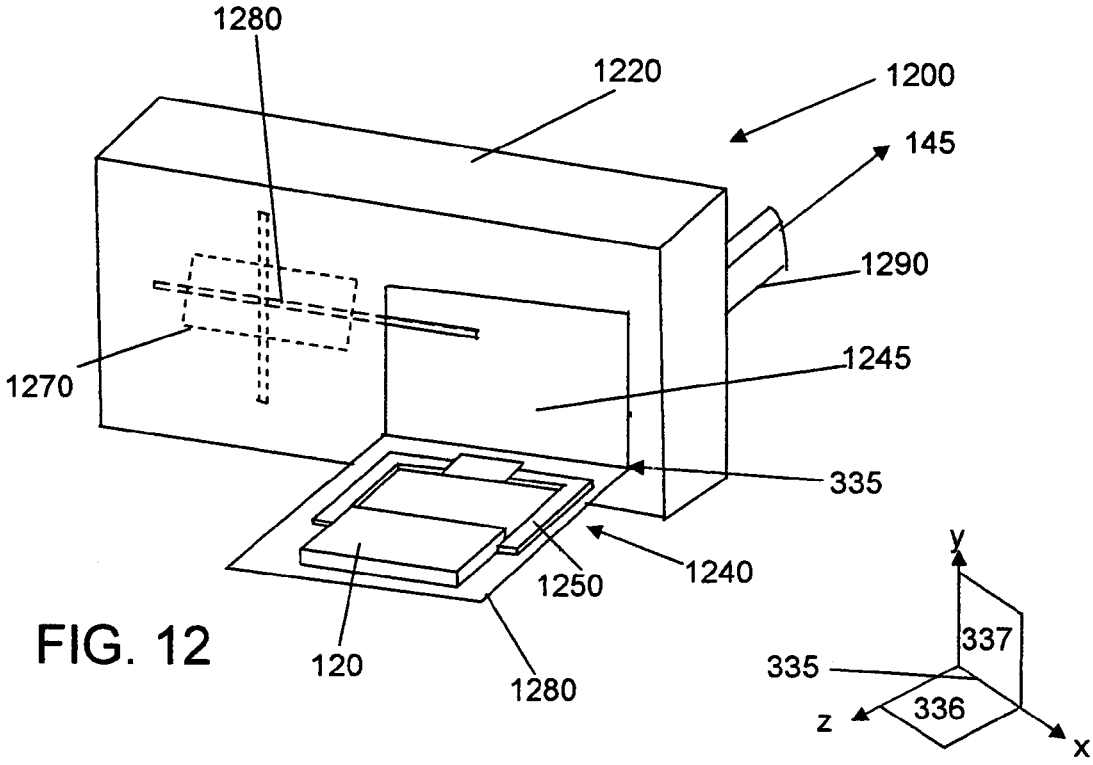
FIG. 12 is a symbolic illustration of a sample plate handling apparatus in yet a further alternative configuration.

FIG. 12 illustrates in symbolic form a sample plate handling apparatus 1200 according to another aspect of the invention. According to this aspect of the invention, the sample plate handling apparatus 1200 is a one chamber system, comprising a pressure chamber 1220. The pressure chamber 1220 of the sample plate handling apparatus 1200 is configured to couple via a gate 1290 to a vacuum chamber of the mass analyzer 145.

The sample plate handling apparatus 1200 has a sample plate receiver 1240 for receiving a sample plate 120 in a first plane (defined by the major axes of the sample plate 120, for example the x and z axes). When accepting a sample plate 120, the gate 1290 between the pressure chamber 1220 and the ion transfer optics of the mass analyzer is closed. In one implementation, the sample plate receiver 1240 includes a first sample plate gripping mechanism 1250 and a door 1280. The first sample plate gripping mechanism 1250 and the door are simultaneously rotated about a pivot axis 335 into the pressure chamber 1220 into the x-y plane, the pressure chamber 1220 is sealed from the atmosphere and the first sample plate gripping structure no longer moves. At this point, the pressure chamber 1220 may be pumped out to achieve the vacuum pressure or other such pressure desired in connection with the mass analyzer 145. The sample plate 120 is transferred from the first sample plate gripping mechanism 1250 to a relocation device 1260, the relocation device 1260 being the moving device. In one implementation, the relocation device 1260 takes the form of a second sample plate gripping mechanism 1270 coupled to an X-Y stage 1280. The relocation device 1260 resides in the pressure chamber 1230 and is responsible for positioning the sample plate 120 such that the impingement of the beam of radiation 110 is aligned with a select region of the sample plate 120, such that ions emanating therefrom align with the ion transfer optics 135 of the vacuum pressure mass analyzer 145. The gate 1290 is opened to allow these ions to enter the mass analyzer 145 (assuming that it has not been opened prior to relocation).

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated, and are therefore considered to be covered by the invention.

What is claimed is:

1. A sample plate handling apparatus for manipulating a sample plate such that sample on the sample plate can be analyzed by a mass analyzer, the apparatus comprising:

a sample plate receiver for receiving a sample plate in a first plane, the sample plate receiver having a first sample plate gripping mechanism that is capable of gripping the sample plate;

a rotating device cooperating with the first sample plate gripping mechanism for rotating the plane of the sample plate from the first plane to a second plane about a pivot axis, the pivot axis being an axis along which the first and the second planes intersect; and a relocation device for moving the sample plate in the second plane such that a sample on the sample plate can be analyzed by a mass analyzer.

2. The apparatus according to claim 1, wherein:

the relocation device moves the sample plate such that when a radiation beam impinges on a sample on the sample plate, ionized particles that emanate from the sample are substantially aligned with ion transfer optics of the mass analyzer.

3. The apparatus according to claim 1, further comprising;

a second sample plate gripping mechanism which cooperates with the first sample plate gripping mechanism to facilitate transference of the sample plate from the first sample plate gripping mechanism to the second sample plate gripping mechanism.

4. The apparatus according to claim 3, wherein:

the relocation device cooperates with the second sample plate gripping mechanism such that moving the second sample plate gripping mechanism causes the sample plate to move in the second plane.

5. The apparatus according to claim 3, wherein:

the relocation means comprises the second sample plate gripping mechanism.

6. The apparatus according to claim 1, wherein:

the second plane is substantially perpendicular to the first plane.

7. The apparatus according to claim 1, wherein:

the first plane is defined by a first and a second axis.

8. The apparatus according to claim 6, wherein:

the second plane is defined by the second and a third axis.

9. The apparatus according to claim 7, wherein:

the relocation device is capable of moving the sample plate along the second and the third axes.

10. The apparatus according to claim 1, wherein:

the sample plate receiver further comprises a transfer mechanism for retracting the sample plate into the sample plate receiver.

11. The apparatus according to claim 1, wherein:

the rotating device causes the sample plate to be moved into a transition chamber when it is moved to the second plane.

12. The apparatus according to claim 11, further comprising:

a pressure chamber, the pressure chamber disposed outside of and coupled to the transition chamber.

13. The apparatus according to claim 12, wherein:

the pressure chamber may be isolated from the transition chamber and may be operated under different pressure conditions to that of the transition chamber.

14. The apparatus of claim 13, wherein:

the pressure chamber may be operated at a pressure that is substantially a vacuum.

15. A sample plate handling apparatus, for manipulating a sample plate such that a sample on the sample plate can be analyzed by a mass analyzer, the apparatus comprising:

a sample plate receiver for receiving a sample plate in a first plane, the sample plate receiver having a first sample plate gripping mechanism that is capable of gripping the sample plate, a transfer mechanism associated with the sample plate receiver for retracting the sample plate into the sample plate receiver, a rotating device for rotating the plane of the sample plate from the first plane to a second plane about a pivot axis, the pivot axis being an axis along which the first and second planes interest, the second plane being substantially perpendicular to the first plane, the rotation moving the sample plate into a transition chamber;

a second sample plate gripping mechanism which cooperates with the first sample plate gripping mechanism to facilitate transference of the sample plate from the first sample plate gripping mechanism to the second sample plate gripping mechanism;

a pressure chamber disposed outside of and coupled to the transition chamber, the pressure region capable of being isolated from the transition chamber and capable of being operated under different pressure conditions to that of the transition chamber;

a relocation that cooperates with the second sample plate gripping mechanism to moving the sample plate in the second plane in the pressure chamber.

16. A method of manipulating a sample plate such that a sample on the sample plate can be analyzed by a mass analyzer, the method comprising the steps of:

(a) receiving a sample plate in a sample plate receiver in a first plane;

(b) rotating the plane of the sample plate from the first plane to a second plane about a pivot axis, the pivot axis being an axis along which the first and second plates intersect;

(c) relocating the sample plate in the second plane such that a sample of the sample plate can be analyzed by a mass analyzer.

17. A method of manipulating a sample plate so that a sample on the sample plate can be analyzed by a mass analyzer, the method comprising the steps of:

(a) receiving a sample plate in a sample plate receiver in a first plane, the sample plate receiver having a first sample plate gripping mechanism that is capable of gripping the sample plate;

(b) retracting the sample plate into the sample plate receiver by means of the first sample plate grip system;

(c) rotating the plane of the sample plate from the first plane to a second plane about a pivot axis, the pivot axis being an axis along which the first and the second planes intersect, the second plane disposed in a transition chamber;

(d) moving the sample plate from the transition chamber to a pressure chamber, the pressure chamber being coupled to the transition chamber;

(e) transferring the sample plate from the first sample plate grip to a second sample plate grip, the second sample plate grip disposed in the pressure chamber;

(f) isolating the transition chamber from the pressure chamber;

(g) pressurizing the pressure chamber to a pressure greater than that of the transition chamber; and (h) relocating the sample plate to a location in the second plane and in the pressure chamber such that a sample on the sample plate can be analyzed by the mass analyzer.

18. A sample plate handling apparatus, for manipulating a sample plate such that a sample on the sample plate can be analyzed by a mass analyzer, the apparatus comprising:

a sample plate receiver for receiving a sample plate in a first plane, the sample plate receiver having a first sample plate gripping mechanism that is capable of gripping a sample plate;

a rotating device for rotating the plane of the sample plate from the first to a second plane about a pivot axis, the pivot axis being an axis along which the first and the second planes intersect, the second plane being substantially perpendicular to the first plane;

a second sample plate gripping mechanism which cooperates with the first sample plate gripping mechanism to facilitate transference of the sample plate from the first sample plate gripping mechanism to the second sample plate gripping mechanism;

a pressure chamber, the pressure chamber coupled to the mass analyzer by a gate;

a relocation device that cooperates with the second sample plate gripping mechanism to move the sample plate in the second plane in the pressure chamber.

* * * * *